US005255863A

United States Patent [19]

Hörndler

[11] Patent Number: 5,255,863

[45] Date of Patent: Oct. 26, 1993

[54] METHOD FOR PRODUCING A COIL

[75] Inventor: Georg Hörndler, Barthelmesaurach, Fed. Rep. of Germany

[73] Assignee: Maschinenfabrik Niehoff GmbH & Co. KG, Schwabach, Fed. Rep. of Germany

[21] Appl. No.: 972,065

[22] Filed: Nov. 5, 1992

Related U.S. Application Data

[63] Continuation of Ser. No. 612,148, Nov. 13, 1990, abandoned, which is a continuation of Ser. No. 326,610, Mar. 21, 1989, abandoned.

[30] Foreign Application Priority Data

Mar. 22, 1988 [DE] Fed. Rep. of Germany ..... 3809635

[51] Int. Cl.[5] ..... B65H 55/00; B65H 54/10

[52] U.S. Cl. ..... 242/159; 242/25 R; 242/175; 242/177

[58] Field of Search ..... 242/159, 174, 175, 176, 242/177, 178, 18 R, 25 R, 47

[56] References Cited

U.S. PATENT DOCUMENTS 4,553,707 11/1985 Henrich ..... 242/25 R 4,739,947 4/1988 Anseel et al. ..... 242/176

FOREIGN PATENT DOCUMENTS 3520195 12/1986 Fed. Rep. of Germany .

*Primary Examiner*—Stanley N. Gilreath

*Attorney, Agent, or Firm*—Kenyon & Kenyon

[57] ABSTRACT

A method for producing a coreless coil of strand-like material in which the strand-like material, which may be wire, insulated or non-insulated cable, glass fiber or the like, is wound in several layers on a substantially cone-shaped winding spool. The layers are inclined with respect to the longitudinal axis of the winding spool. The first pair of layers each contain $N_1$ windings. The second pair of layers each contain $N_2=N_1+\Delta N$ windings, where N is a constant value. In this manner, the number of windings for consecutive layer pairs is increased until the total number of possible windings for a predetermined winding pitch is reached. The layers of each pair are wound by a take-up apparatus that moves in a first direction for winding one of the layers of a pair and in a second opposite for direction for winding the other layer of the pair. A coreless coil produced by such a method, an apparatus for carrying out the method, and an apparatus for unwinding a coreless coil also are disclosed.

28 Claims, 4 Drawing Sheets

METHOD FOR PRODUCING A COIL

This application is a continuation of application Ser. No. 07/612/148, filed on Nov. 13, 1990, now abandoned which is a continuation of application Ser. No. 07/326,610 filed on Mar. 21, 1989, now abandoned.

BACKGROUND OF THE INVENTION

The present invention relates generally to a coil, skein or bunch of strand-like stock, for example, wire, insulated or non-insulated cable, glass fiber or the like, and more particularly to an improved method for producing such a coil and apparatus for carrying out the improved method.

Frequently during the processing of strand-like stock, such as wire, the need arises for further processing of the wire that cannot be carried out at the same coil location, often, not even in the same plant, in which the wire itself was manufactured. The strand-like stock must then be prepared in a suitable way for transport and brought to the location where the further processing occurs. Several problems or disadvantages have arisen as result of the preparation required for transportation of the stock. Commonly, the winding material is wound on winding cores or spools for transportation together with the wound material. Therefore, a large number of spools must be stored at the corresponding locations or plants, which requires a considerable investment cost. Further, considerable costs arise because the empty spools must be transported back from the processing point to the original production plant. Moreover, the spools also increase the transport weight of the wound stock, which produces an increase in transportation costs.

In order to avoid the aforementioned problems and disadvantages, a need has developed in the industry for strand-like stock, such as wire or cable, that is not wound on spools, but rather transported and delivered as skeins or bunches that substantially are comprised only of the actual strand-like material itself and possibly a cover or other packaging for the coil. This type of coil is usually referred to as a one-way packaged coil.

A method for producing a one-way packaged coil is disclosed in DE-OS 3520195. In this known method a cone-shaped winding spool is used. The strand-like stock is wound on the cone-shaped spool in individual layers parallel to one another. An adhesive then is provided, which binds the individual windings and layers to one another. When further processing occurs, the wire is unwound from the inside.

There are number of serious disadvantages that result from employing this method and the coil that results therefrom. First of all, use of an adhesive in the production of the coil is disadvantageous because it makes the method complicated and expensive. In addition, the adhesive can disrupt further processing of the coil and, therefore, in some circumstances it must initially be removed. Furthermore, entanglement of the wire layers can occur, despite the use of adhesive, especially, when approaching the end of the unwinding process as the adhesive forces between the individual layers degenerate, resulting in several windings coming loose at once.

The invention is directed to a method for producing a coil that can be carried out more simply and inexpensively than heretofore possible, while at the same time providing a stable coil that can be transported and processed without incurring the disadvantages and problems of the prior art. Advantageous apparatus for carrying out the method of the invention and for unwinding a coil also are disclosed.

SUMMARY OF THE INVENTION

The invention accomplishes these goals by providing a method of producing a coil of strand-like material wound in layers on a substantially cone-shaped surface of a winding core or spool having a cone aperture angle, with the layers being inclined with respect to the cone-shaped surface of the winding spool and in which a take-up apparatus is employed that moves approximately parallel to the longitudinal axis, comprising the steps of (a) beginning the winding process at a starting diameter on the portion of the winding spool having the smallest diameter; (b) initially winding a first layer $L_{1a}$ having a predetermined number of windings $N_1$ onto the substantially cone-shaped surface of the winding spool at an acute angle relative to the substantially cone-shaped surface which is greater than one-half of the cone-aperture angle by moving the take-up apparatus in a first direction, where the number $N_1$ is smaller than the maximum number $N_{max}$ of windings that can be applied to the spool at a predetermined winding pitch; (c) winding a second layer $L_{1b}$ onto the first layer $L_{1a}$ by reversing the movement of the take-up apparatus in a second direction opposite the first direction, with the second layer $L_{1b}$, having substantially the same number of windings $N_1$ as the first layer $L_{1a}$; and (d) winding additional layers $L_{2a}$, $L_{2b}$, $L_{3a}$, $L_{3b}$, . . . $L_{xa}$, $L_{xb}$ and so forth onto winding layers $L_{1a}$ and $L_{1b}$ such that the additional layers have a number of windings $N_2$, $N_3$ . . . $N_x$, respectively, that increases for each additional layer by a substantially constant winding factor $\Delta N$ until the maximum number $N_{max}$ of windings are wound on the winding spool wherein the first, second, and additional pairs of layers form a double-cone shape.

Thus, the method of the invention is carried out such that at least one layer $L_{1a}$ is wound with $N_1$ number of windings. When the number $N_1$ is reached, the direction of movement the take-up roll is reversed and a layer $L_{1b}$ is wound back to the starting point of the first layer $L_{1a}$. Layers $L_{1a}$ and $L_{1b}$ have essentially the same number of windings $N_1$. The next layer $L_{2a}$, which is wound in the same direction as the layer $L_{1a}$, has a number of windings $N_2 > N_1$, where the difference between the number $N_2$ and the number $N_1$, corresponds to the winding factor $\Delta N$. The substantially constant winding factor is added to the following windings, until the layers extend between the coil flanges, to ensure the desired double cone-shaped structure of the coil results. This means that the winding number $N_3$ for the layers $L_{3a}$ and $L_{3b}$ is again increased by the winding factor $\Delta N$ and so on for further layers.

According to one embodiment of the invention, the winding factor may lie in the range between 2 and 6, preferably between 3 and 5. With this winding factor, a cone aperture angle of between 12° and 16° is provided, more preferably, between 13° and 15°. The cone aperture angle is understood as being the total opening angle of the winding spool during the winding process. This means that with a cone aperture angle of, for example, 16°, the intersection line of the cone in a cross-section that includes the longitudinal axis of the winding spool is inclined by 8° with respect to the longitudinal axis. Winding the layers onto the substantially cone-shaped surface of the winding spool at an angle greater than this angle, i.e., greater than one-half the cone aperture angle or 8° in this example, ensures that the advantageous double-cone coil shape results. According to a further embodiment of the invention, the winding factor lies in the range between 6 and 12, preferably between 7 and 11. With this winding factor, a preferred cone aperture angle lies in range between 0° and 12°.

In accordance with the method of the invention, the winding process may be carried out with different winding pitches, i.e., the space in between two windings of the same layer, depending upon the diameter of the winding stock. A winding pitch of 1.5 to 3.0 is advantageous because in this range small deviations of the wire height when wire is being taken up and unwound do not adversely influence the stability of the coil.

The method for producing one-way packaged coils of strand-like stock of the invention has considerable advantages over the method known in the art. Through the specially controlled winding process of the invention, it is possible to provide coils formed in the shape of a double cone. This shape enables the individual windings to support each another, which results in a coil structure that is much more stable for transport, and obviates use of an adhesive.

Furthermore, the method of the invention provides a completed coil that can be unwound in a particularly simple and reliable manner. In principle, the coil of the invention can be unwound from either the inside or from the outside. When unwinding from the inside, the coil is typically arranged such that the longitudinal axis of the coil is vertical and the larger inside diameter of the coil is located at the bottom. If the wire then is withdrawn from the interior of the coil, each winding is supported by the winding below, due to the angle of inclination provided by the cone-shaped winding spool. In this manner, the wire winding cannot fall downwardly and become entangled.

Unwinding from the outside of the coil also can be accomplished with the coil of the invention, which was not possible with coils heretofore known in the art. According to this aspect of the invention, the coil may be arranged with its longitudinal axis in the vertical direction and the smaller inside diameter of the coil at the bottom. Subsequently, an unwinding disc may be placed on the coil whose diameter is equal to or larger than the outside diameter of the coil. The unwinding disc preferably can rotate. The strand-like stock, for example, wire or cable, is then withdrawn from above or "overhead" as the stock is passed over the disc. Unwinding of the coil in this manner also enables the windings to support one another. Each winding is supported from the winding below because the winding diameter is larger than the diameter of the previously unwound winding and, hence, the upper winding cannot slip downwardly.

The double-cone shape of the coil ensures that, regardless of whether the coil is unwound from the inside or the outside, it remains in a very stable condition, which makes it possible to arbitrarily interrupt and restart the unwinding process, without fear that the winding will slip and the strand-like material tangle during the standstill. The high stability of the coil also substantially simplifies transport of the coil.

The method of the invention can be employed with very different types of strand-like material. The method is particularly suited for winding wire. Furthermore, it was discovered that the method of the invention is particularly well-suited for simultaneously winding several twisted or untwisted stranded cables. Being able to perform these functions is a particular advantage of the invention, since simultaneously winding several cables, which must later be unwound and separated again, is an important aspect of cable manufacturing. Furthermore, the invention enables the winding of finished stranded cables and also of insulated cable and the like. In addition, glass fibers also can be wound by the method of the invention.

In accordance with one embodiment of the invention, the winding spool can rotate during the winding process. In this case, an upwardly and downwardly moving take-up or traverser roll may be employed for guiding the strand-like stock to the respectively desired height or location on the spool. Due to the rotation of the winding spool, a twist-free winding of the stock may be effectuated. It should be noted that in this embodiment, the rotary speed of the winding spool must vary according to the position of the take-up apparatus to ensure that for a constant wire feed speed, each diameter of the winding spool has the same tangential speed.

According to a further embodiment of the invention, the winding spool may be stationary during the winding process. In this case, the take-up apparatus revolves around the spool to wind the strand-like around the winding spool in accordance with the winding method of the invention. The strand-like stock then, in general, has a twist, since the stock is rotated by 360° for each winding. This twisting can be undone when unwinding the spool, by unwinding or fly-off in the correspondingly opposing direction. If the twisting is desired for further processing, e.g. for producing stranded cables, the twist can be increased by one further revolution per winding during take-off.

According to another aspect of the method of the invention, parallel layers of windings can be applied after reaching the maximal winding number $N_{max}$, i.e. as soon as the first layer reaches the flange of the winding spool lying opposite the starting flange. In each of the parallel layers, the number of windings is substantially equal. In this manner, the advantageous, inclined form of the outer winding layers is maintained. When the first parallel winding layer reaches the maximum diameter of one of the spool flanges, the windings may continue such that the coil forms an outer cylindrical shape. For this purpose, the take-up apparatus is controlled in essentially the same way as in the start of the winding process, but the winding number, which is equal to $N_{max}$ now, is correspondingly reduced by the substantially constant winding value $\Delta N$, which is the number of additional windings that was added to the initial winding layers. This feature of the invention produces the advantage of better utilization of the volume of the coil.

An apparatus for carrying out the method of the invention is disclosed as comprising (a) a substantially cone-shaped winding core having first and second axially spaced flanges arranged substantially perpendicular to the longitudinal axis of the winding core; (b) a take-up apparatus movable in at least first and second opposite directions to guide the strand-like material at respective predetermined heights as the material is wound onto the winding spool in layers; (c) a counter for counting the number of windings wound within the layers on the winding core; (d) a comparator operably connected to the counter for generating an output signal when a predetermined number of windings N is wound within a layer on the winding spool, the signal being operably connected to the take-up apparatus for reversing the direction of movement of the take-up apparatus; and (e) an adder for summing a predetermined value to the number of windings last counted by the counter to determine the new value of windings N to be wound in the next layer.

The coil of the invention may be formed from strand-like material, selected from the group consisting essentially of wire, insulated stranded cable, non-insulated stranded cable and glass fiber. The coil may include a substantially cone-shaped packaging for the coil, such as a paper cover or the like, which may be applied to the winding apparatus before the winding process starts instead of being applied to the coil after the winding process is complete. The cover has first and second axially spaced, removable flanges that are arranged substantially perpendicular to the longitudinal axis of the cover. If such a cover is used, the strand-like material is wound in layers on the cover and the layers are inclined with respect to the substantially cone-shape surface of the cover. A first pair of layers of windings, each containing a predetermined number of windings $N_1$, is wound onto the substantially cone-shaped surface at an acute angle relative to the substantially cone-shaped surface which is greater than one-half of the cone aperture angle of the cover. $N_1$ is smaller than the maximum number of windings that can be applied to the cover at a predetermined winding pitch. A second pair of layers of windings each containing $N_2=N_1+\Delta N$ windings is wound onto the first pair where $\Delta N$ is a substantially constant winding value. Additional pairs of layers of windings then are wound, with each pair containing a number of windings $N_3$, $N_4 \ldots N_x$, respectively, that increases for each additional layer by N until the windings extend from the first flange to the second flange wherein the first, second, and additional pairs of layers form a double-cone shape.

DETAILED DESCRIPTION

The method of the invention and a winding apparatus for carrying out the method are described in conjunction with FIGS. 1–4, which illustrate an embodiment provided with a rotating winding spool. The winding apparatus comprises the actual winding core 1, which is conically shaped and has a cone aperture angle schematically indicated at 2. The winding apparatus further comprises a first flange 3 and second flange 4, both of which are perpendicular to the longitudinal axis 5 of the rotatable winding core 1. The two flanges are disc-shaped and have no conical surfaces. The second flange 4 is removable such that the winding apparatus can be removed from the finished coil. Furthermore, the winding apparatus may be taken apart to simplify removal thereof.

Figure 1:
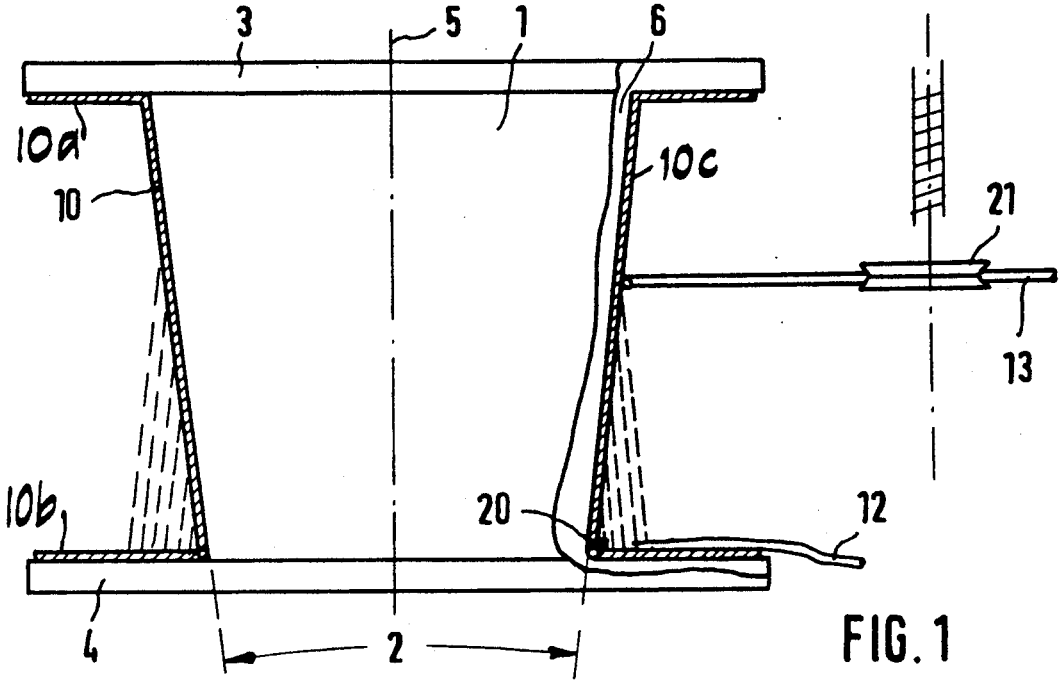
FIG. 1 shows a schematic partially cross-sectional view through winding apparatus for carrying out the method of the invention.
Figure 2:
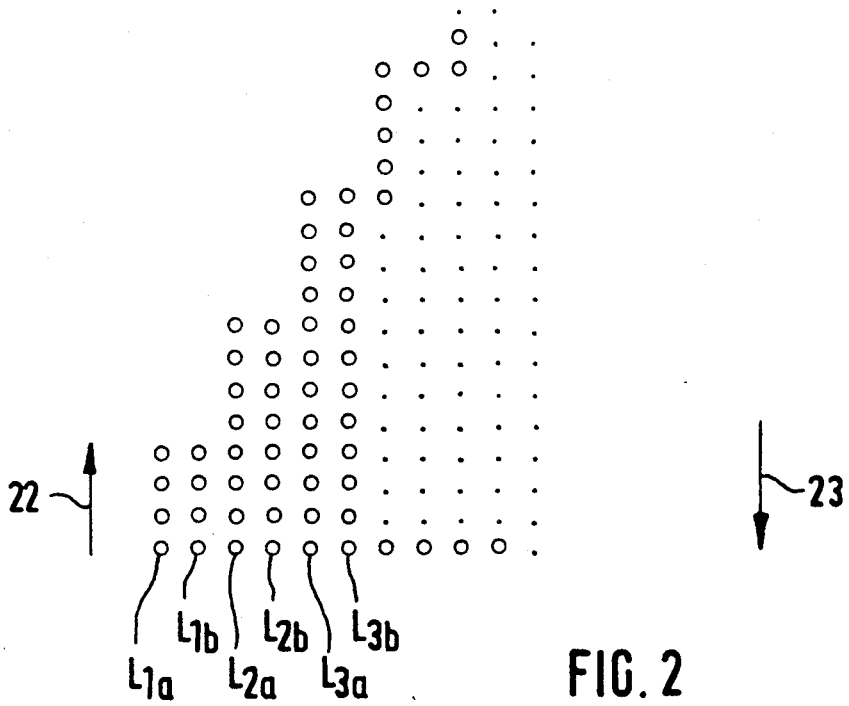
FIG. 2 schematically illustrates the winding or take-up process of the invention.

A thin packaging cover 10 may be applied to the winding apparatus and is adapted to conform to the contour of the apparatus. The thin cover 10 may be formed, for example, of paper and may remain after completion of the coil to increase the rigidity of the coil for transport or to facilitate unwinding from the outside. Cover 10 includes spaced flanges **10*a*, 10*b*, as shown in FIG. 1, and a substantially conical surface 10*c* lying parallel against the corresponding conical surface 6 of winding core 1. As is readily apparent to those of ordinary skill in the art, flanges 10*a*, 10*b*** are removable, such as by cutting, tearing or the like, or are bendable to facilitate unwinding of the coil, if necessary.

Take-up or winding of the strand-like stock, in the present case a wire or cable 12, begins at the flange of the winding spool that is arranged on the part of the spool that has the smallest diameter. The wire 12 first is loosely passed over the second flange 4. The take-up process then begins with the winding 20, which represents the first winding wound on the spool. Take-up occurs in conjunction with a take-up or traverser roll 21, which is controlled in its upward and downward movement for guiding the wire 13. The wire is fed at a substantially constant speed to the rotating spool 1. The control of the take-up roll is best illustrated schematically in FIG. 2. Take-up begins with application of the layer $L_{1a}$, which in the present case comprises four windings vertically wound as the roll 21 moves in the direction of the arrow 22. The windings are wound onto the substantially cone-shaped surface 6 of the winding core 1, or surface **10*a* of the cover 10 if provided, at an angle greater than one-half of the cone-aperture angle 2. This ensures that the outer surface 44 of the inner coil portion 40 (see FIG. 4) tapers toward the inner surface 41, which follows the incline of conical surface 6 (or 10*c* if cover 10** is provided) to form a double cone shape, the advantages of which are discussed subsequently.

Then the take-up roll reverses its direction and winds four more windings as it moves back in the direction of arrow 23 to form the layer $L_{1b}$. The number of windings or the winding number $N_1$ of layer 1 therefore is 4. Following this convention, the layer $L_2$ is wound, with the number of windings $N_2$ in this layer calculated from the equation:

$$N_x=N_{x-1}+\Delta N$$

where $N_x$ is the number of windings in layer X; and $N_{x-1}$ is the number of windings in the preceding layer, i.e. layer X−1.

In the present case, $\Delta N=4$, i.e. it is coincidentally equal to the number $N_1$ of the first layer $L_1$. According to this equation, the layer $L_{2a}$ receives 8 windings, which are wound in conjunction with movement of roll 21 in the direction of the arrow 22. The layer $L_{2b}$ also receives 8 windings, which are wound as roll 21 moves in the direction of the arrow 23. For the next layer $L_{3a}$, $N_3=N_2+\Delta N$ or $8+4=12$ windings, the layer $L_{4a}$ (not referenced) has 16 layers, the layer $L_{5a}$ has 20 layers, etc. The number of windings is increased by a constant amount for each new layer wound in the same direction or movement of roll 21. This constant amount can be varied according to the particular configuration the coil desired. The conical shape that results from this process, as illustrated in the figures, is the aggregate result of a number of windings about the core, and represents the general geometric shape that a winding so produced tends towards after a number of windings.

Figure 3:
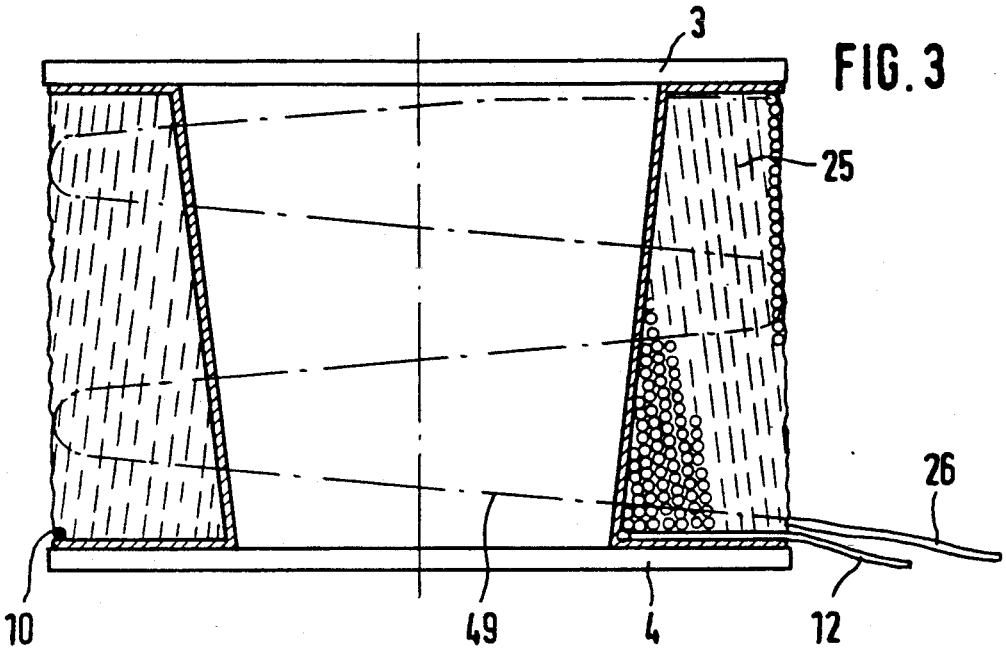
FIG. 3 shows a coil produced according to the method of the invention.
Figure 4:
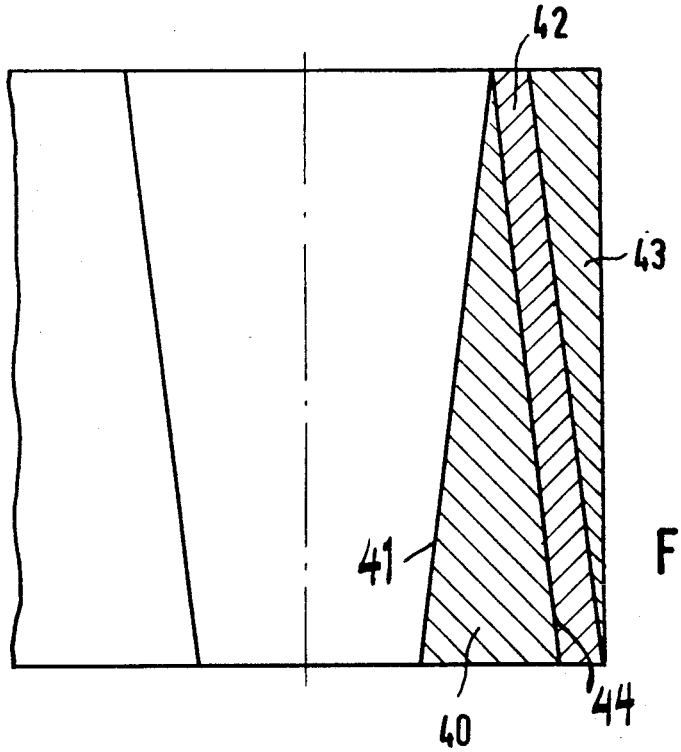
FIG. 4 is a schematic representation of the structure of the various layers of the coil of FIG. 3.

The continuation of the winding process is more clearly shown in FIGS. 3 and 4. The winding process continues in the manner described above, until the number of windings is so large that the windings reach the opposing first flange 3. As soon as this point is reached, the following layers are wound with the same number of windings to produce parallel layers. This is schematically illustrated by the parallel dashed lines 25 shown in FIG. 3.

Winding of the parallel layers continues until the outer edge of the second flange 4 is reached. At this point, the winding process either may end or continue by applying a respectively reduced number of windings, essentially opposite from the beginning of the winding process of the invention such that the coil receives an outer cylindrical form. The end of the wire 26 is then returned to the starting point of the process by a few large pitch windings 49 such that the end 26 lies next to the beginning of the wire 12.

The schematic configuration of the wire windings is best illustrated in FIG. 4. The wire coil consists of an inner portion 40, which is formed in a double cone shape, i.e. it tapers at its inner surface as a cone and widens at its outer surface as a cone. This double cone form provides an essential advantage in that during unwinding in the upright or vertical position, as the wire reaches the inner layers, which are always critical during unwinding, the diameter of the coil windings increases in the downward direction thereby supporting the windings from falling downward, regardless of whether unwinding is performed from the inside or outside. This is quite advantageous because it enables provision of a commercial coil product that does not depend on the specific requirements of a particular customer, i.e., whether unwinding must occur from the inside or outside of the coil.

In addition to double cone portion 40 in the illustrated embodiment, a parallel winding portion 42 is formed by the invention whose diameter also increases in the downward direction. It is noted, however, that provision of parallel portion 42 is not necessary, as it is readily possible to configure the coil with only the double cone portion.

In the region 43, which adjoins the parallel region 42, the layers are arranged such that a cylindrical outer coil form results. This form can be achieved by exactly reversing the winding process that led to formation of the first portion 40 of the winding, i.e., $N_x=N_{x-1}-\Delta N$. Provision of outer coil portion 43 of the winding may be optional.

Figure 5:
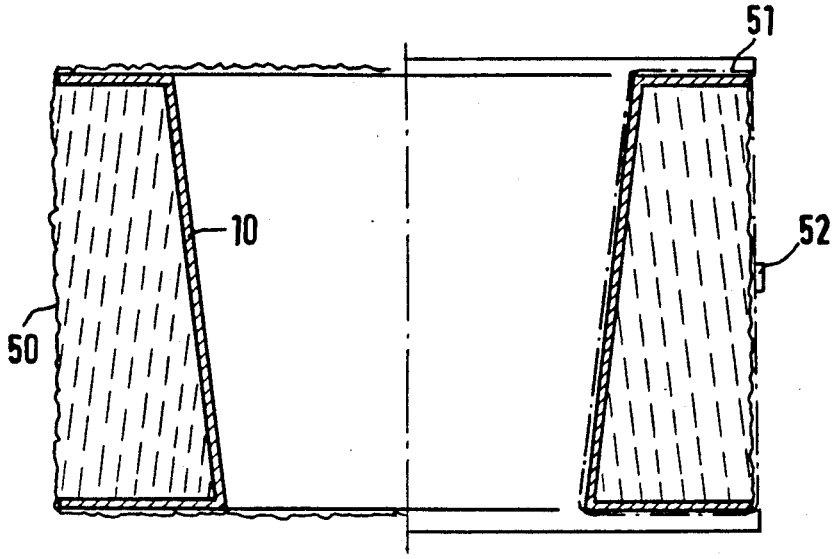
FIG. 5 shows the coil of the invention packaged for delivery.

A coil produced in accordance with the method of the invention is illustrated in FIG. 5 in a condition ready for delivery. As noted above, the coil may include a paper or cardboard packaging cover 10, which provides additional stability. Furthermore, an outer cover 50 formed of, for example, plastic foil, may be provided to protect the coil from dirt during transport. Further stability for transport may be achieved with bands 51, which are placed around the coil as shown in FIG. 5. To simplify mounting of these bands, corresponding channels may be provided in the winding spool. Further, plastic or steel bands 52 may be circumferentially arranged around the coil to provide for even further stability.

Figure 6:
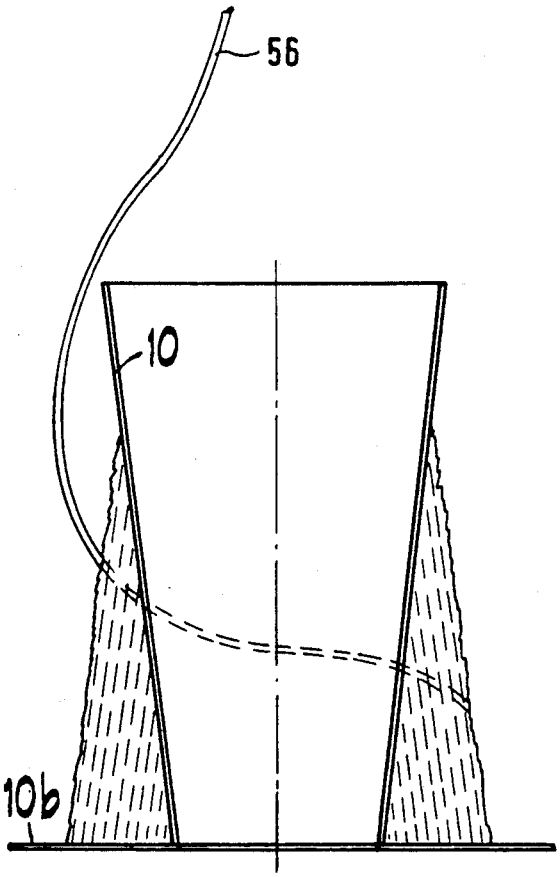
FIG. 6 shows the unwinding of the coil of the invention from the outside without use of any auxiliary unwinding apparatus.
Figure 7:
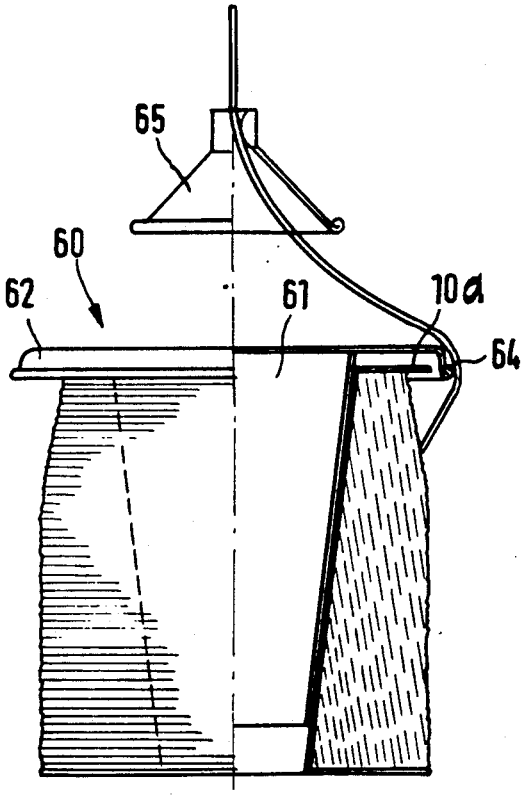
FIG. 7 shows the unwinding of the coil of FIG. 5 from the outside in conjunction with a special take-off device.

FIG. 6 shows how the winding material can be taken off or unwound from the coil without the need for any further unwinding apparatus. This occurs as the coil is set in the upright position such that the end with the smaller inside diameter of the coil faces downwardly. Naturally, any packaging such as covers 10, 50 and bands 51, that would interfere with unwinding is first removed. Although not necessary as indicated by FIG. 7, flange 10*a* has been removed from the coil shown in FIG. 6. The wire 56 then can be withdrawn from above, preferably, through an eyelet (not shown).

Figure 10:
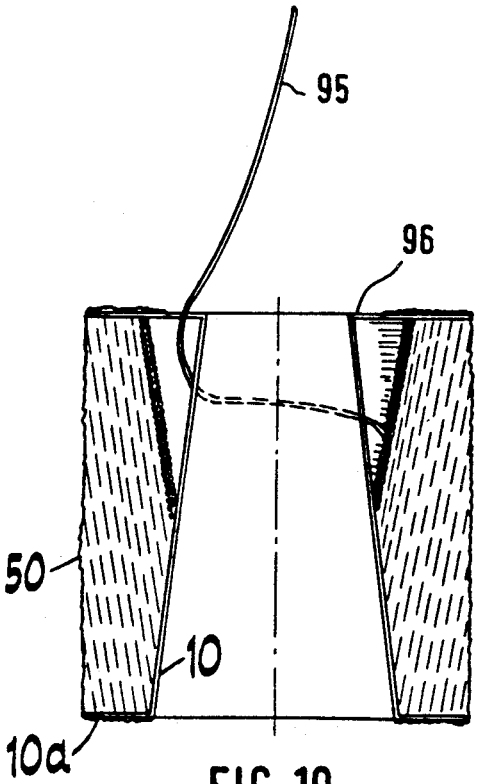
FIG. 10 shows unwinding of the coil of the invention from the inside of the coil.

In the same manner it also is possible to unwind the coil from the inside. However, for inside take-off, in order to take advantage of the double cone effect, the coil is placed such that the portion with the larger inside diameter faces downwardly. Thus, the coil is rotated 180° with respect to the illustrated coil position of FIG. 6. This type of inside take-off is shown in FIG. 10, which illustrates the wire 95 being withdrawn from the middle 96 of the coil. As is readily apparent to those of ordinary skill in the art, inside take-off requires removal of flange 10*b* (if cover 10 is provided) and any other packaging that might hinder unwinding. Thus, flange 10*b* and the portion of the foil 50 present at the small diameter end of the coil have been removed from the coil shown in FIG. 10.

FIG. 7 illustrates unwinding of the coil of FIG. 5 in conjunction with a take-off apparatus. Take-off apparatus 60, which comprises a core 61 and a rotatable disc 62, is inserted into the cardboard section 10 of the coil. Rotatable disc 62 includes a circular ridge 64 at its outer circumference. Unwinding occurs via the disc by drawing the strand-like stock wound on the coil through an eyelet 65 arranged along the longitudinal axis of the coil. As unwinding occurs from the outside via disc 62, removal of flange 10*a* is not necessary. The eyelet is connected to further unwinding apparatus in a manner that is not shown.

As is recognizable from FIG. 7, the individual windings are taken off consecutively one after the other and each subsequent winding in this region of the coil has a larger diameter than the previously unwound winding. Downward slippage of the windings thereby is avoided and, therefore, entanglement of the strand-like material, in particular, by a stoppage of the unwinding process, cannot arise during unwinding.

Although unwinding of the coil from the outside is a preferred form of unwinding of the coil of the invention, as discussed above, it also is possible to unwind the wire from the inside, depending on the needs of the customer. Thus, inside unwinding, which is possible with the coil of the invention, also lies within the scope of the invention.

Figure 8:
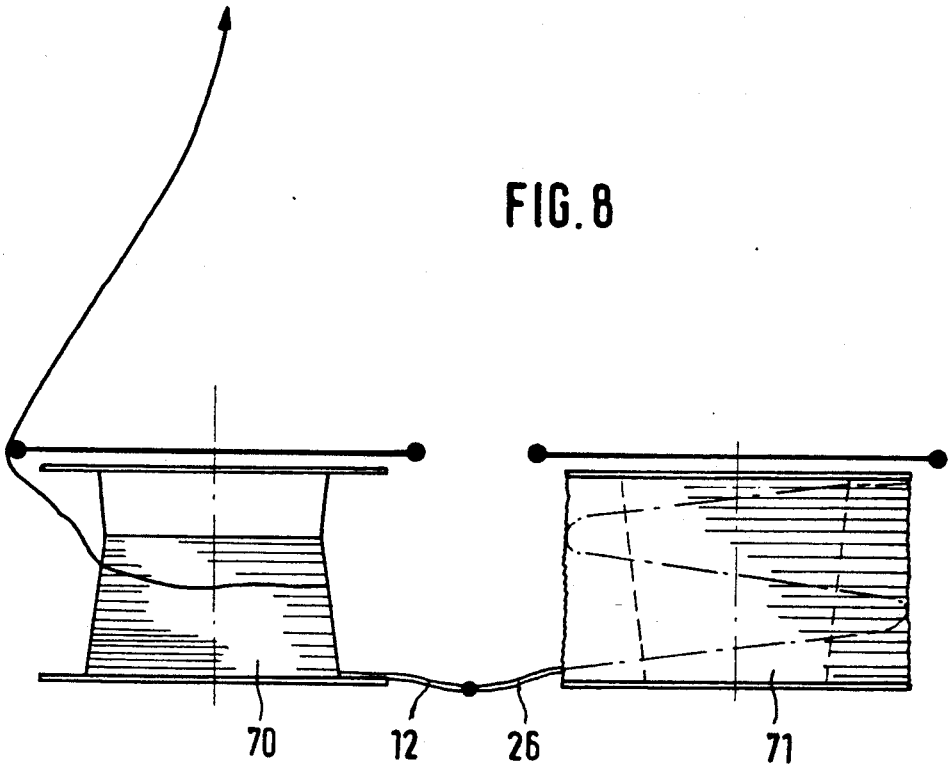
FIG. 8 shows the unwinding of several coils of the invention.

FIG. 8 illustrates how two coils formed according to the invention can be connected to one another to provide a transition, without a loss of time in the unwinding process, from a first coil 70 to a second coil 71. As shown in FIG. 8, the end of the wire 12 leading to the outside of coil 70 is connected to the end of the wire 26 of coil 71, which also leads to the outside. When the first coil 70 is unwound, the unwinding process continues with the second coil 71 without interruption. A third or fourth coil also can be connected in the same manner.

Figure 9:
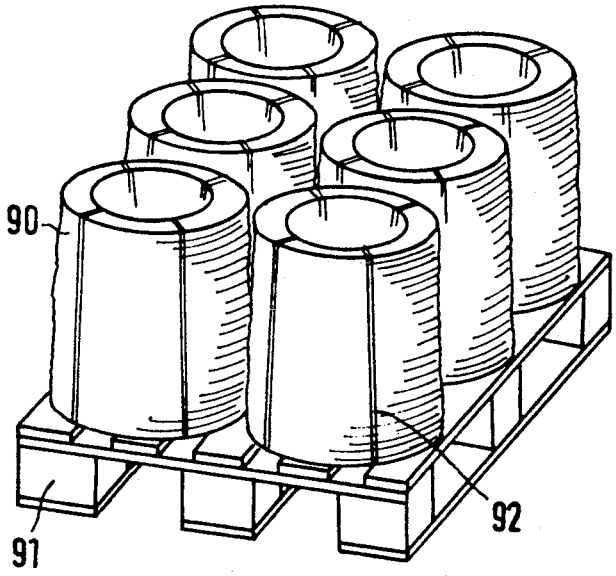
FIG. 9 shows an arrangement of several coils of the invention prepared for transport.

FIG. 9 illustrates how several coils produced according to the invention can be prepared for transport. As shown therein, the coils 90 can be arranged on a pallet 91 without any further auxiliary apparatus. To provide the coils with sufficient stability, bands 92 may also be provided in a manner similar to bands 51, as discussed above.

What is claimed is:

1. A method of producing a coil of strand-like material wound in layers on a conical surface of a substantially cone-shaped winding spool having a cone-aperture angle, with the layers being inclined with respect to the conical surface, and in which a take-up apparatus is employed that moves approximately parallel to the longitudinal axis, comprising the steps of:

(a) beginning the winding process at a starting diameter on the portion of the winding spool having the smallest diameter;

(b) initially winding a first layer $L_{1a}$ having a predetermined number of windings $N_1$ onto the conical winding spool at an acute angle relative to the conical surface, which is greater than one-half of the cone-aperture angle, by moving the take-up apparatus in a first direction, where the number $N_1$ is smaller than the maximum number $N_{max}$ of windings that can be applied to the spool at a predetermined winding pitch;

(c) winding a second layer $L_{1b}$ onto the first layer $L_{1a}$ by reversing the movement of the take-up apparatus in a second direction opposite the first direction, with the second layer $L_{1b}$ having substantially the same number of windings $N_1$ as the first layer $L_{1a}$;

(d) winding additional pairs of layers $L_{2a}$, $L_{2b}$, $L_{3a}$, $L_{3b}$, . . . $L_{xa}$, $L_{xb}$, and so forth onto winding layers $L_{1a}$ and $L_{1b}$ such that the additional layers have a number of windings $N_2$, $N_3$ . . . $N_x$, respectively, that increases for each pair of additional layers by a substantially constant winding factor $\Delta N$ until the maximum number $N_{max}$ of windings are wound on the winding spool to form a double-cone shaped winding portion having an inner surface disposed parallel to the conical surface and an outer surface tapering toward the inner surface at an angle equal to the acute angle; and (e) removing the winding spool from the coil.

2. The method according to claim 1 further comprising winding parallel layers onto the additional pairs of layers to form a parallel winding portion after the maximum number of windings $N_{max}$ are wound and before the winding spool is removed, each of the parallel layers being inclined at an angle equal to the acute angle and having substantially the same number of windings.

3. The method according to claim 2 further comprising winding outer layers onto the parallel winding portion having a decreasing number of windings per layer after a predetermined maximum diameter of the winding coil is reached and before the winding spool is removed, such that the coil has a substantially cylindrical outer diameter.

4. The method according to claim 1 wherein the substantially constant winding factor lies in the range between 2 and 6.

5. The method according to claim 4 wherein the cone aperture angle lies in the range between 12° and 16°.

6. The method according to claim 1 wherein the substantially constant winding factor lies in the range between 6 and 12.

7. The method according to claim 6 wherein the cone aperture angle lies in the range between the 0° and 12°.

8. The method according to claim 1 wherein winding steps (a)–(d) are carried out such that the distance between the two adjacent windings of the same layer is between 1.5 and 3.0 times the diameter of the strand-like material.

9. The method according to claim 1 including rotating the winding spool during at least steps (b)–(d).

10. The method according to claim 1 including maintaining the winding spool stationary during at least steps (b)–(d) and revolving the take-up apparatus around the spool.

11. A coil of the strand-like material produced by the method of claim 1.

12. A coil of strand-like material produced by the method of claim 10 wherein the strand-like material has a twist.

13. A coil of strand-like material produced by the method of claim 9 wherein the strand-like material is twistless.

14. The method according to claim 1 wherein the conical surface of the substantially cone-shaped winding spool is provided on a removable winding core and further comprising the steps of i) placing a coil packaging cover on the removable core before beginning the winding process such that the cover has a conical surface substantially conforming to the conical surface of the winding spool upon which the first layer $L_{1a}$ is wound; and ii) leaving the packaging cover in place with the coil after removing the winding core from the coil.

15. A coil of strand-like material having a coil packaging cover produced by the method of claim 14.

16. A coil of strand-like material produced by the method of claim 1 further comprising bands surrounding the coil for supporting the coil in its originally wound position.

17. A coil of a strand-like material produced by the method of claim 1 wherein the strand-like material comprises a plurality of individual cables.

18. A coil of strand-like material, selected from the group consisting essentially of wire, insulated stranded cable, non-insulated stranded cable, and glass fiber, comprising a double-cone shaped section of windings including:

an inner surface layer of windings disposed at an inner circumference of the coil and defining a central conical opening through the coil having a cone aperture angle, said inner surface layer substantially conforming to the cone aperture angle and having a decreasing diameter from top to bottom of the coil; and an outer surface layer of windings tapering toward the inner surface layer from bottom to top of the coil at an acute angle which is greater than one-half the cone aperture angle such that the diameter of the windings of the double-cone shape section increases from top to bottom of the coil along both the inner and outer surface layers.

19. The coil of claim 18 further comprising a section of parallel windings disposed adjacent the outer surface layer at an angle equal to the acute angle, with each layer of parallel windings having substantially the same number of windings.

20. The coil of claim 19 further comprising an outer section of windings disposed adjacent the parallel winding section and having a decreasing number of windings per layer such that the coil has a substantially cylindrical outer diameter.

21. A coil of strand-like material, selected from the group consisting essentially of wire, insulated stranded cable, non-insulated stranded cable and glass fiber, comprising:

(a) a substantially cone-shaped packaging cover having first and second axially spaced flanges arranged substantially perpendicular to the longitudinal axis of the cover and a conical surface defined by a cone aperture angle of the cover, with the strand-like material being wound in layers on the cover and the layers being inclined with respect to the longitudinal axis of the cover;

(b) a first pair of layers of windings each containing a predetermined number of windings $N_1$ wound on the conical surface of the cover at an acute angle relative to the conical surface which is greater than one-half of the cone aperture angle, where $N_1$ is smaller than the maximum number of windings that can be applied to the cover at a predetermined winding pitch;

(c) a second pair of layers of windings each containing $N_2=N_1+\Delta N$ windings wound onto the first pair, where $\Delta N$ is a substantially constant winding value; and (d) additional pairs of layers of windings wound onto the second pair, each additional pair containing a number of windings $N_3$, $N_4 \ldots N_x$, respectively, that increases for each additional pair of layers by $\Delta N$ until the windings extend from the first flange to the second flange and the first, second, and additional pairs of layers form a double cone shaped winding portion having an inner surface disposed parallel to the conical surface and an outer surface tapering toward the inner surface at an angle equal to the acute angle.

22. The coil of claim 21 further comprising parallel layers of windings wound onto the additional pairs of layers, with each parallel layer containing substantially the same number of windings.

23. The coil according to claim 22 further comprising outer winding layers containing a number of windings per layer that decreases in a direction from the parallel layers to the outermost layer thereby producing a substantially cylindrical outer coil diameter.

24. The coil according to claim 23 wherein the substantially constant winding value lies in the range between 2 and 6.

25. The coil according to claim 24 wherein the cone aperture angle lies in the range between 12° and 16°.

26. The coil according to claim 21 wherein the substantially constant winding value lies in the range between 6 and 12.

27. The coil according to claim 23 wherein the cone aperture angle lies in the range between 0° and 12°.

28. The coil according to claim 21 wherein the distance between any two adjacent windings is between 1.5 to 3.0 times the diameter of the strand-like material.

* * * * *

UNITED STATES PATENT AND TRADEMARK OFFICE

CERTIFICATE OF CORRECTION

PATENT NO. : 5,255,863

DATED : October 26, 1993

INVENTOR(S) : Georg Horndler

It is certified that error appears in the above-indentified patent and that said Letters Patent is hereby corrected as shown below:

Column 12, line 29, change "23" to --24--.

Signed and Sealed this

Twentieth Day of June, 1995

*Attest:*

*Attesting Officer*

BRUCE LEHMAN

*Commissioner of Patents and Trademarks*